US005488453A

United States Patent [19]

Labudde et al.

[11] Patent Number: 5,488,453

[45] Date of Patent: Jan. 30, 1996

[54] OPERATOR CONTROL INTERFACE MOUNTING MECHANISM

[75] Inventors: Brian R. Labudde, Rochester; Frank Hacknauer, Honeoye Falls, both of N.Y.

[73] Assignee: Eastman Kodak Company, Rochester, N.Y.

[21] Appl. No.: 283,010

[22] Filed: Jul. 29, 1994

[51] Int. Cl.[6] ..... G03G 21/00

[52] U.S. Cl. ..... 355/202; 355/200; 355/209; 248/920

[58] Field of Search ..... 355/200, 202, 355/208, 209, 204–207; 371/16.4, 16.5, 29.1; 248/917, 920, 285

[56] References Cited

U.S. PATENT DOCUMENTS

| | | | |
|---|---|---|---|
| 4,515,086 | 5/1985 | Kwiecinski et al. | 108/96 |
| 4,561,619 | 12/1985 | Robillard et al. | 248/285 |
| 4,640,485 | 2/1987 | Day et al. | 248/920 X |
| 4,648,574 | 3/1987 | Granlund | 248/285 X |
| 4,659,048 | 4/1987 | Fahrion | 248/920 X |
| 4,852,500 | 8/1989 | Ryburg et al. | 108/105 |
| 5,038,169 | 8/1991 | Marincic et al. | 355/200 |
| 5,159,546 | 10/1992 | Inoue et al. | 355/200 X |
| 5,182,796 | 1/1993 | Shibayama et al. | 355/209 X |
| 5,202,726 | 4/1993 | McCulley et al. | 355/206 |

*Primary Examiner*—Matthew S. Smith
*Attorney, Agent, or Firm*—Lawrence P. Kessler

[57] ABSTRACT

A reproduction apparatus having a housing, a logic and control unit for controlling the operation of the reproduction apparatus, a user control interface for inputting control instruction signals to said logic and control unit, and a mechanism for mounting said user control interface so as to be usable by a variety of users. The mounting mechanism includes a user control interface support platform slidably supported for movement, relative to the reproduction apparatus housing to a home position and a position spaced from the home position where the user control interface is readily accessible by a user. The platform is automatically moved to its home position when a portion of the reproduction apparatus housing is opened to provide access to the interior of such housing.

22 Claims, 10 Drawing Sheets

OPERATOR CONTROL INTERFACE MOUNTING MECHANISM

BACKGROUND OF THE INVENTION

The present invention relates in general to a mechanism for mounting a user (operator) control interface on a reproduction apparatus, and more particularly to a user control interface mounting mechanism which automatically moves the interface to a remote location when a portion of the reproduction apparatus is opened for access to the interior thereof.

In typical reproduction apparatus, such as copiers or printers or the like, a user control interface is utilized to enable control instruction signals to be sent to a logic and control device for programming the operation of the reproduction apparatus. As new reproduction apparatus become more sophisticated in the operational modes that they can accomplish, they become concomitantly more complex to program. It is therefore important that in order to efficiently program a reproduction apparatus, the user control interface be as simple and straight forward to operate as possible.

Recent advances have enabled user interactive devices to be utilized as user control interface devices. A well known example of an interactive device is a touch activated screen in association with a cathode ray tube (CRT) through appropriate software. Interactive devices present easy to understand interactive displays which substantially simplify programming of the reproduction apparatus. Such displays are flexible and provide for extensive use of complex reproduction apparatus. However, since the associated reproduction apparatus are generally large pieces of equipment with various associated accessories, in order to utilize the interactive type user control interface such interface must be adjustable to be readily accessible to the users. An example of a modern reproduction apparatus employing an interactive user control interface is so found in U.S. Pat. No. 5,038,169 (issued Aug. 6, 1991, in the name of Marincic et al). The apparatus of this patent shows an interactive user control interface slidable laterally along the top portion of the reproduction apparatus for improved user viewing when the user assumes various stations relative to the apparatus.

Another problem associated with interactive user control interface devices for relatively large reproduction apparatus is accommodating users of a wide variety of physical characteristics (particularly height and reach). To permit the reproduction apparatus to be accessed by a substantial portion of the general population, the interactive touch screen must be readily activated by persons even of substantially less than average height and reach. This means that the user control interface must be near the front of the reproduction apparatus to accommodate the largest percentage of users. Since such location is likely to interfere with necessary access to the interior of the reproduction apparatus, the user control interface is typically located adjacent to an end of the apparatus. This positions the user at an inconvenient location relative to the main areas of the reproduction apparatus, and makes it difficult to monitor operation of the apparatus while interacting with the user control interface.

Summary of the Invention

In view of the foregoing discussion, this invention is directed to a reproduction apparatus having a housing, a logic and control unit for controlling the operation of the reproduction apparatus, a user control interface for inputting control instruction signals to said logic and control unit, and a mechanism for mounting said user control interface so as to be usable by a variety of users. The mounting mechanism comprises a user control interface support platform slidably supported for movement to a home position and a position spaced from the home position where the user control interface is readily accessible by a user. The platform is automatically moved to its home position when a portion of the reproduction apparatus housing is opened to provide access to the interior of such housing.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
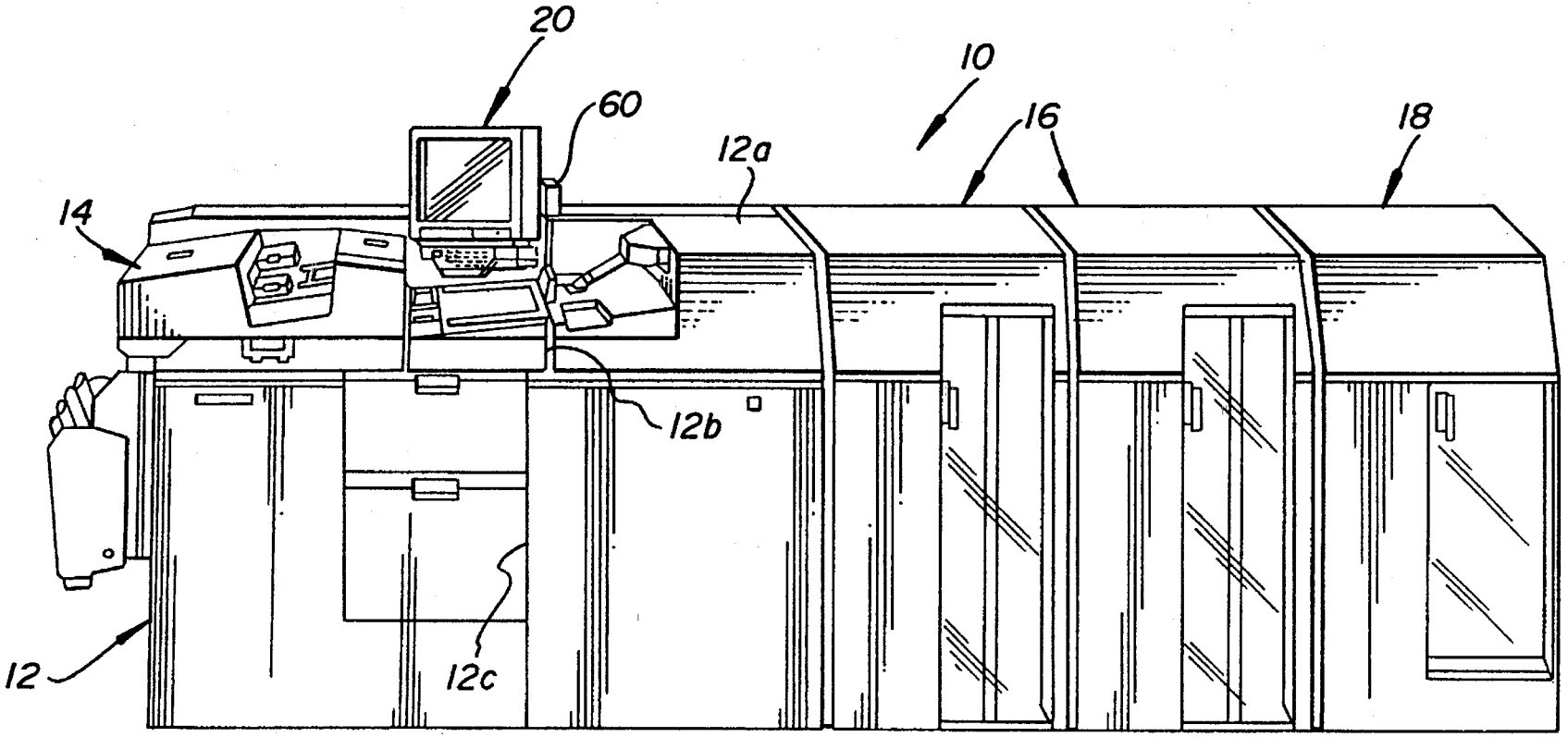
FIG. 1 is a front elevational view of a typical reproduction apparatus, incorporating an interactive user control interface, mounted on the reproduction apparatus housing, according to this invention.

Referring now to the accompanying drawings, a typical reproduction apparatus, designated generally by the numeral 10, is shown in FIG. 1. The reproduction apparatus 10 includes a reprographic marking engine 12 for reproducing information supplied thereto, and a variety of accessories for facilitating the handling of original document sheets and/or reproduction output from the marking engine. In the apparatus 10 shown here, the accessories include an original document sheet feeder 14, a plurality of sorter towers 16, and a stacker/stapler 18. The original document sheet feeder, sorter towers, and stacker/stapler are all of any particular construction well known in the art of reproduction apparatus.

The marking engine 12 of the depicted reproduction apparatus 10 is, for example, an electrographic copier or printer, or a combination of the two. Generally speaking, a copier reproduces information from original documents by optical exposure of such documents, while a printer reproduces information from electronic signals representative of such information. Of course, other arrangements for reproduction apparatus, utilizing a different type of marking engine, or a different number or arrangement of accessories, are suitable for use with this invention. With any suitable marking engine, it is well known to mount the covers (e.g., 12*a*, 12*b*, 12*c*, etc) of the housing thereof so as to enable the covers to be respectively opened for ready access to the interior of the housing. Such access is necessary, for example, for clearing jams, for adding or changing consumable supplies, or for making repairs to the marking engine.

In any arrangement for the reproduction apparatus 10, many different modes of user selectable operations or functions are possible. For example, duplex document booklets may be formed from simplex or duplex original information, or information to be copied may be edited to change its size, content, or orientation. Further, the typical reproduction apparatus 10 has the ability to communicate to the user its status with regard to operating conditions or supply status, for example. As will be appreciated, with such communication required between the user and the apparatus or the apparatus and the user, a highly sophisticated communication interface is required.

Figure 4:
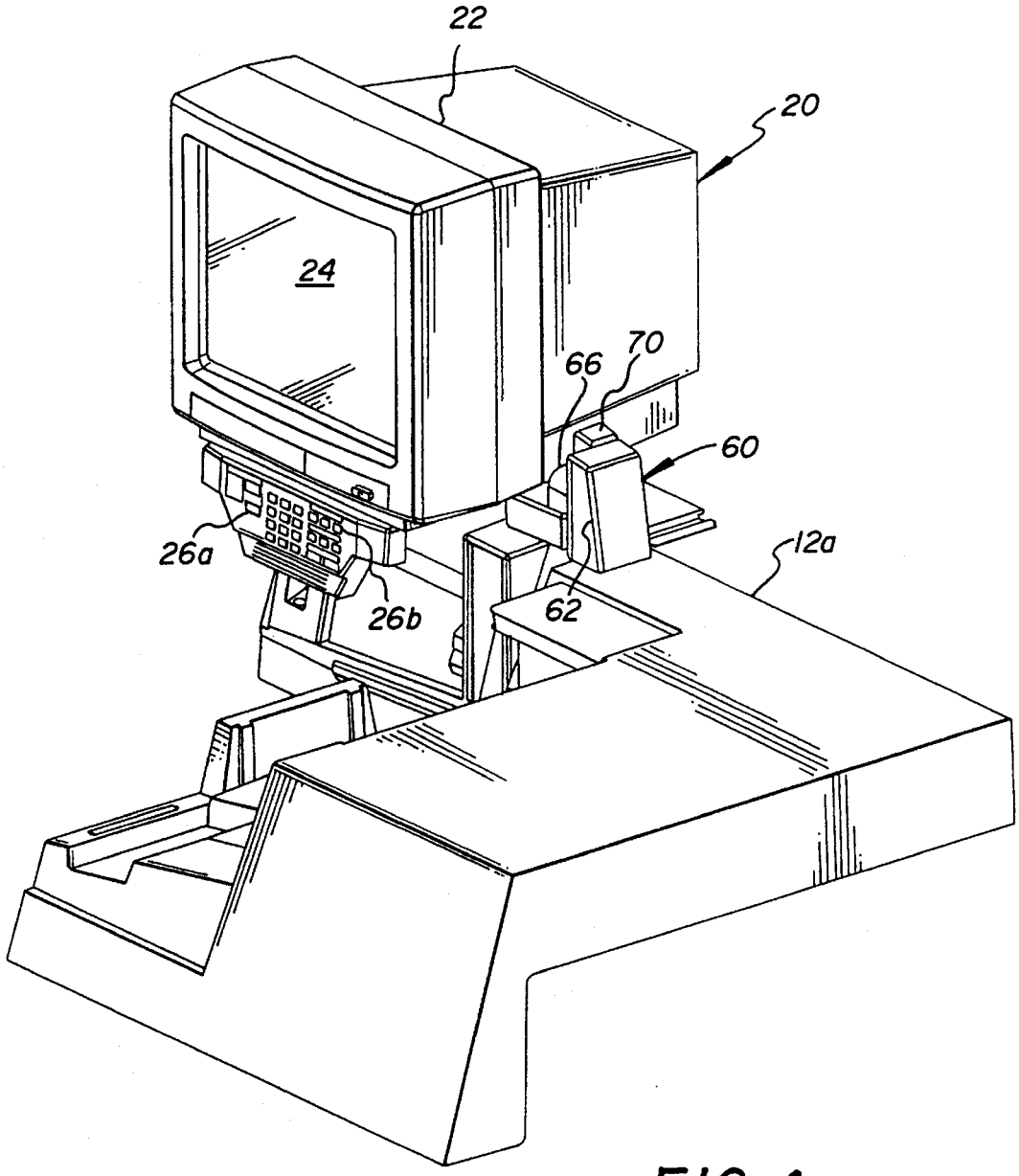
FIG. 4 is a view, in perspective and on an enlarged scale, of the user control interface and the associated top cover of the reproduction apparatus housing.

The user communication interface, according to this invention, as shown for example in FIGS. 1, 2, and 4, is designated generally by the numeral 20. Such user interface 20 includes a CRT 22 contained in a housing, a touch activated screen 24 overlying the CRT 22, and a plurality of sets of manually activated keys 26*a*, 26*b*. The user interface 20 is electrically coupled in any well known manner to a logic and control unit (not shown)located within the housing of the reproduction apparatus 10. The logic and control unit includes a microprocessor based controller electrically coupled to the marking engine and accessories of the reproduction apparatus 10. Of course, the user interface 20 may alternatively include a stand alone logic and control unit which would then, in turn, be electrically coupled to the logic and control unit of the reproduction apparatus.

In order to control the reproduction apparatus 10, the controller of the logic and control unit receives input signals from the user interface 20 and a plurality of sensors (not shown) associated in any well known manner with the reproduction apparatus marking engine and accessories. Based on such signals and a program for the microprocessor, the logic and control unit produces appropriate signals to control the various operating devices within the reproduction apparatus. The production of a program for a number of commercially available microprocessors is a conventional skill well understood in the art, and do not form a part of this invention. The particular details of any such program would, of course, depend upon the architecture of the designated microprocessor.

In view of the size of the typical reproduction apparatus 10, it is necessary to mount the user interface 20 in a manner, according to this invention, which will enable it to be accessed by a large percentage of the general population of users. As shown in FIG. 2*a*, a user U of less than average height would have difficulty in easily activating the touch screen 24 of the user interface 20 when the user interface is in its home (rearmost) position. On the other hand, if the user interface is moved in a direction from back to front with respect to the reproduction apparatus 10 to a position (see FIG. 2*b*) spaced from the home position, the less than average height user can readily activate the touch screen 24. FIG. 3 is a graphical representation of a user's forward functional reach plotted against height from the floor. The plotted lines labeled A through J respectively, represent the forward reach of percentiles of the general population. The point labeled X is selected as the point for the center of the touch screen 24 when the user interface is in its most forward position according to this invention, such that the touch screen can be readily activated by more than 95% of the general population.

It is of course likely that with most arrangements of typical reproduction apparatus, when the user interface 20 is in its most forward (spaced) position, the housing of the CRT 22 of the user interface will interfere with the opening of the top covers of the housing of the reproduction apparatus marking engine. That is, when it is necessary to access the interior of the marking engine housing for any well known purpose as discussed above, if the user interface 20 has not been returned to the home (rearmost) position, lifting of a top cover can severely damage the top cover or the user interface.

Figure 2B:
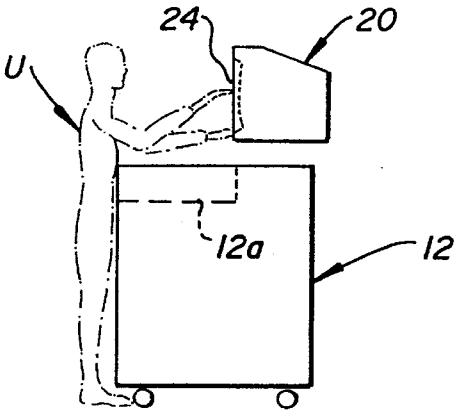
FIGS. 2*a* and 2*b* are generally schematic side elevational views depicting a typical user in association with the reproduction apparatus user control interface, respectively at the range limits, to demonstrate the users forward functional reach.
Figure 2A:
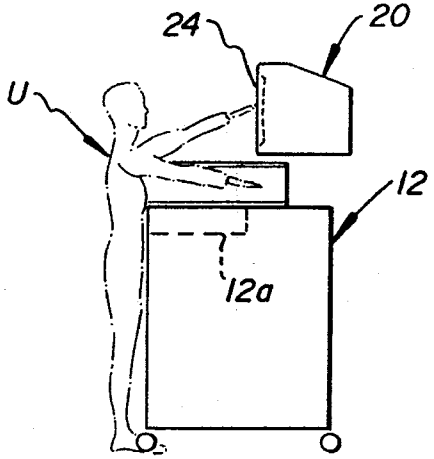
Figure 3:
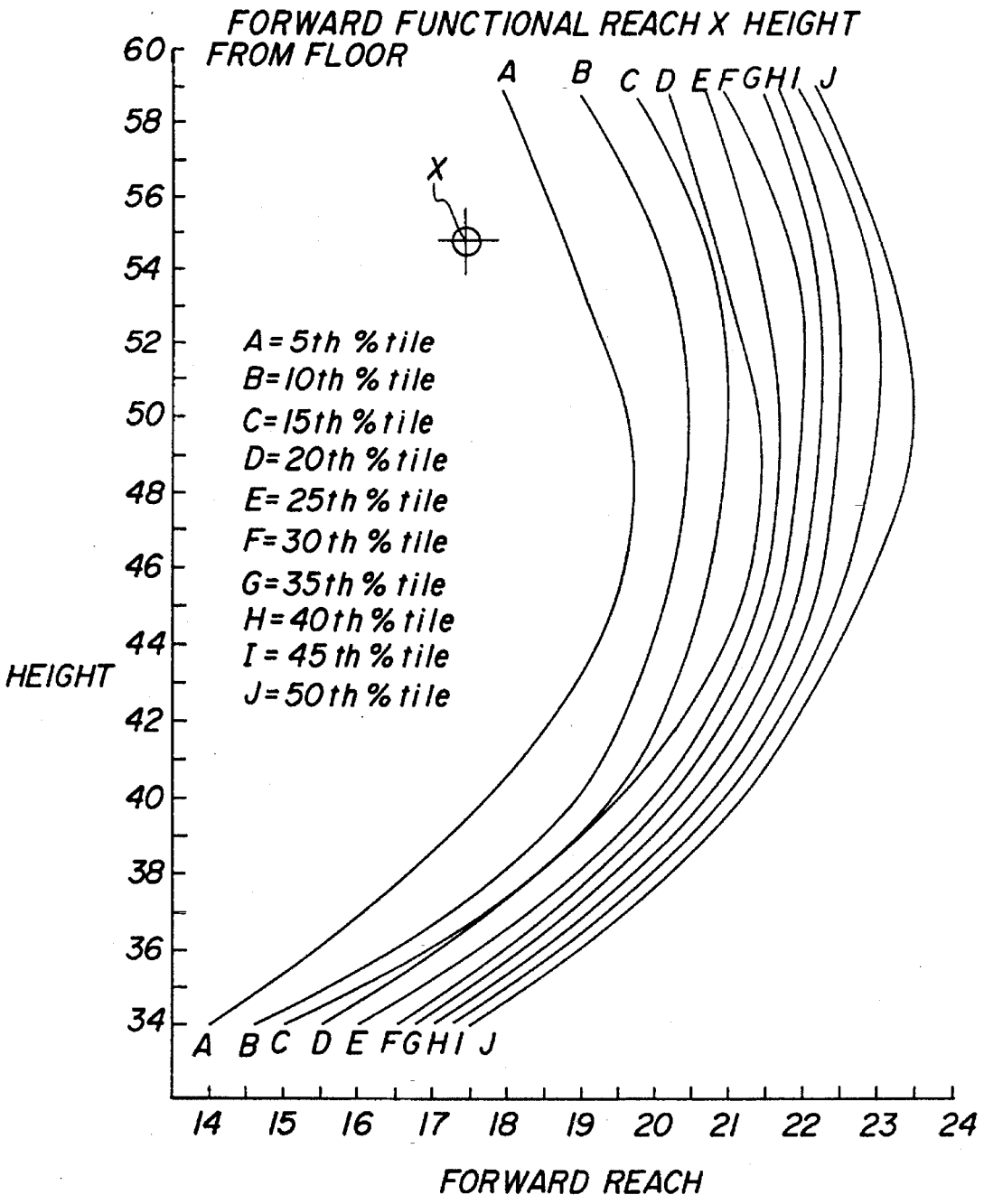
FIG. 3 is a graphical representation of a user's forward functional reach plotted against height from the floor.

According to this invention, the user interface 20 is mounted on the reproduction apparatus 10 so as to enable the user interface to move relative to the marking engine housing to and from the rearmost home position (FIG. 2*a*) to the most forward spaced position (FIG. 2*b*). The mounting mechanism, designated generally by the numeral 40 and best shown in FIGS. 5 and 6, includes a platform 42 secured to the bottom of the CRT housing 22 of the user interface to form a support therefor. The platform 42 is, in turn, supported on a base member 44 for slidable movement relative thereto. Such slidable movement is provided by any well known slide arrangement.

Figure 5:
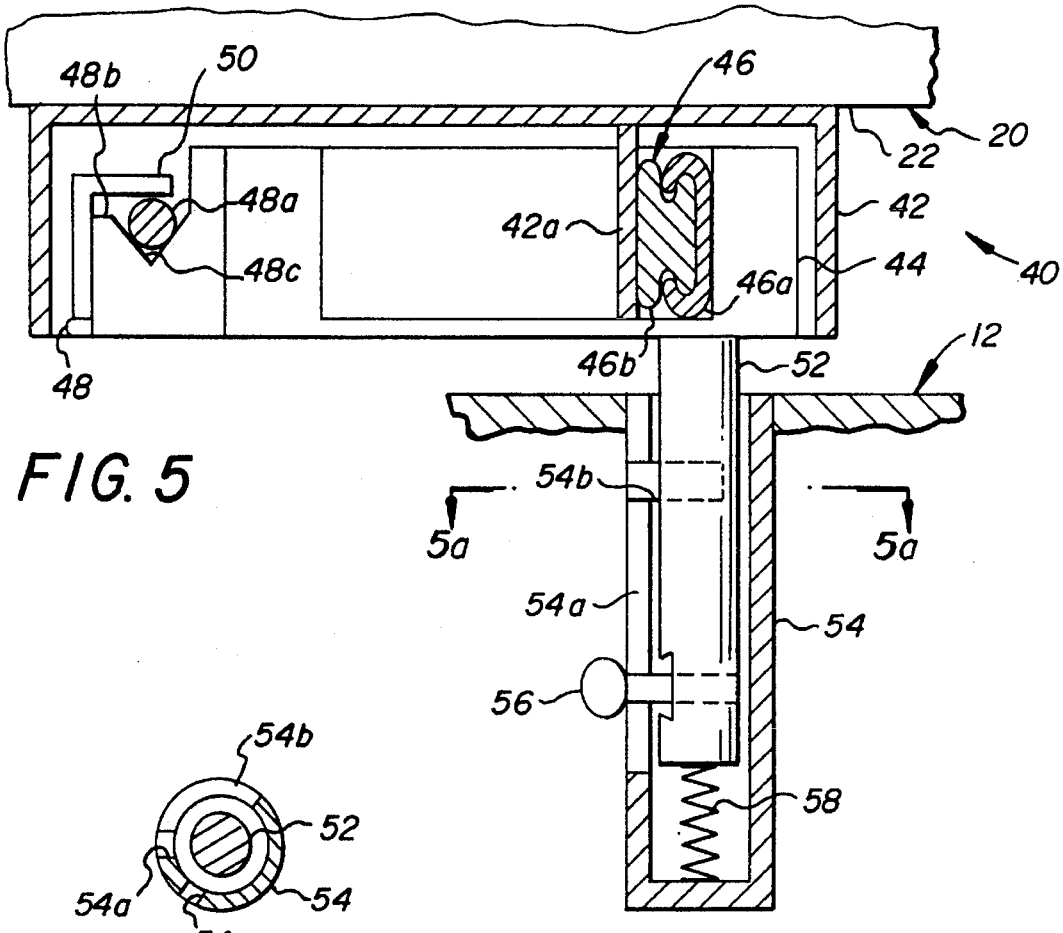
FIG. 5 is a front elevational view, on an enlarged scale and in cross-section, of the user interface slide support, with portions removed to facilitate viewing.
Figure 6:
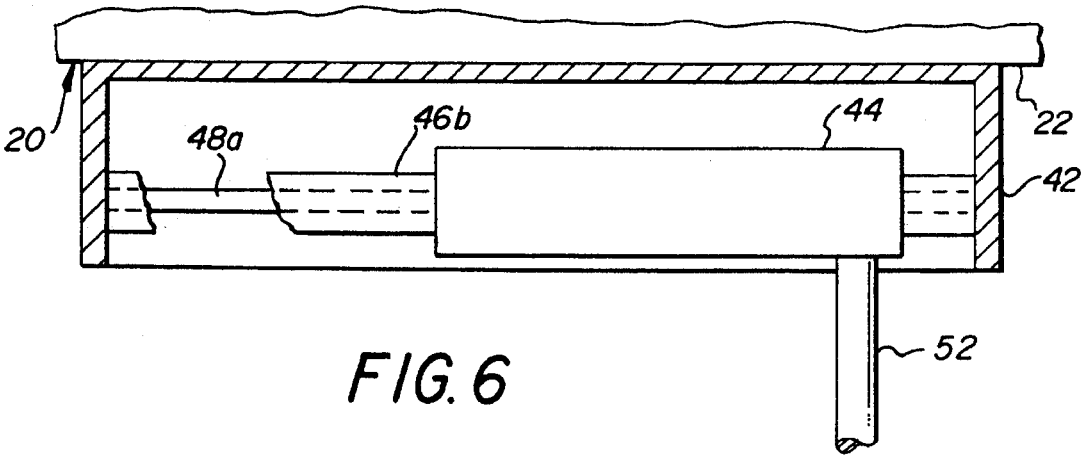
FIG. 6 is a side elevational view, on an enlarged scale and in cross-section, of the user interface slide support, with portions removed to facilitate viewing.

In the preferred embodiment shown in FIGS. 5 and 6, the slide arrangement for the user interface support platform includes a rail-type slide 46 adjacent one longitudinal edge of the base member 44, and a rod-in-groove support 48 adjacent to the opposite longitudinal edge. The slide 46 has a first member 46*a*, attached to the base member 44, cooperating with guide member 46*b*, attached to a web portion 42*a* extending downwardly from the bottom of the platform. The rod-in-groove support 48 includes a rod 48*a*, attached to the platform 42. The rod is supported in a block 48*b* defining a V-shaped groove 48*c*. The block 48*b* is attached to the base member 44 such that the groove 48*c* has a longitudinal axis substantially parallel to the longitudinal axis of the slide 46. An angle member 50 is attached to the base member 44 and overlies the rod 48*a* so as prevent the rod from escaping from the groove 48*c*.

Such multiple configuration slide arrangement for the user interface support platform 42 is preferred because it represents a system which is not over constrained. That is, this system will accommodate for some misalignment between the components of the slide arrangement, and prevent binding which might otherwise occur with a system having two sets of slides similar to the slide 46 (an over constrained condition).

Figure 5A:
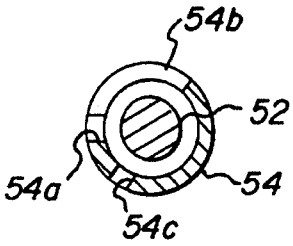
FIG. 5*a* is a cross-sectional view of the user interface pivot support, taken along the lines 5*a*—5*a* in FIG. 5, with portions removed to facilitate viewing.

The base member 44 is mounted on a pivot bar 52 for rotation therewith. The pivot bar 52 is, in turn, supported in substantially vertical orientation in a tubular receptacle 54 located in the housing of the marking engine 12, for example toward the rear thereof adjacent to top cover 12*b*. The bar 52 is free to rotate within the receptacle 54. The receptacle has a first slot 54*a* and a second slot 54*b* defined thereby. The slot 54*a* extends along a longitudinal element of the tubular receptacle, while the slot 54*b* extends about a portion of the circumference of the receptacle and intersects slot 54*a*. A locating pin 56 extends radially from the bar 52 and is received in the slot 54*a* to keep the bar from rotating about its longitudinal axis in normal operation. Selectively, the user interface 20 can be raised along the longitudinal axis of the pivot bar 52, and rotated (from the solid line position of FIGS. 7 and 8 to the broken line position) to a service position. That is, as the user interface 20 is raised, the locating pin 56 is brought to a vertical elevation adjacent to the slot 54*b*. The user interface can then be rotated about the longitudinal axis of the bar 52. Once the user interface has been rotated to the service position, the locating pin 56 is inserted a distance through the bar 52 so that a projecting end thereof engages the slot 54*c* (see FIG. 5*a*) of the receptacle in the same plane as the slot 54*b*. Accordingly, when the user interface 20 is in the raised and rotated position (the service position), it is securely maintained in such position as desired.

The user interface is returned to the operational position (from the broken line position of FIGS. 7 and 8 to the solid line position) by reversing the described procedure. It is noted that ideally a compression spring 58 (or other suitable motion dampening device) is located in the receptacle 54 between the bar 52 and the bottom of the receptacle. The spring 58 prevents the user interface 20 from dropping violently down, when it is rotated back to the user operational position, in a manner which might damage the user interface.

Figure 7:
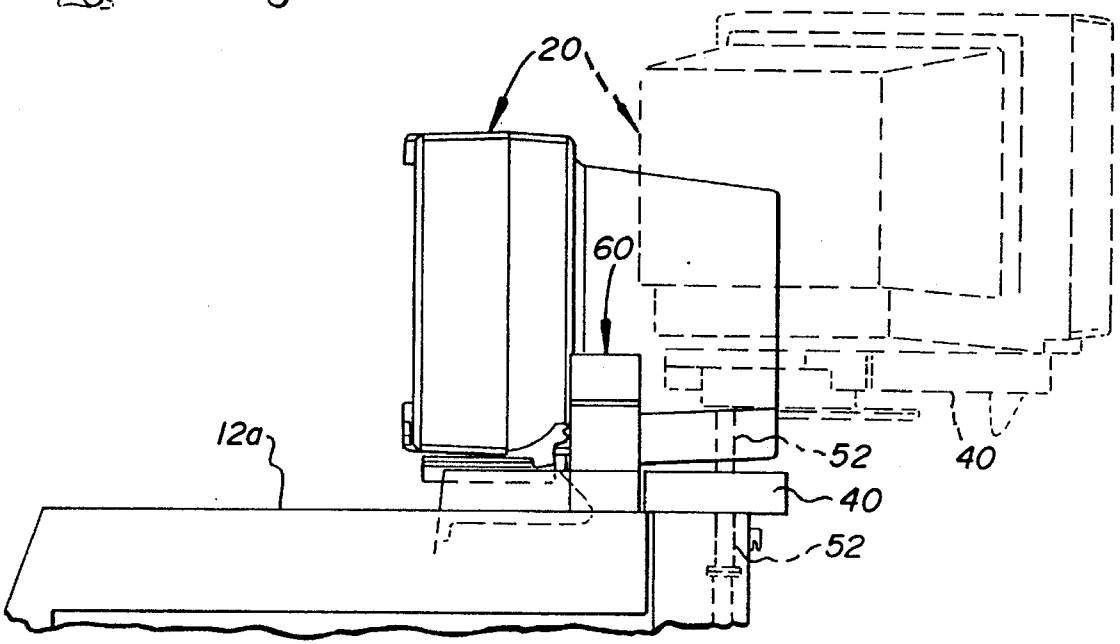
FIG. 7 is a side elevational view of the user control interface, particularly showing the pivotable mounting for the user control interface support platform.
Figure 8:
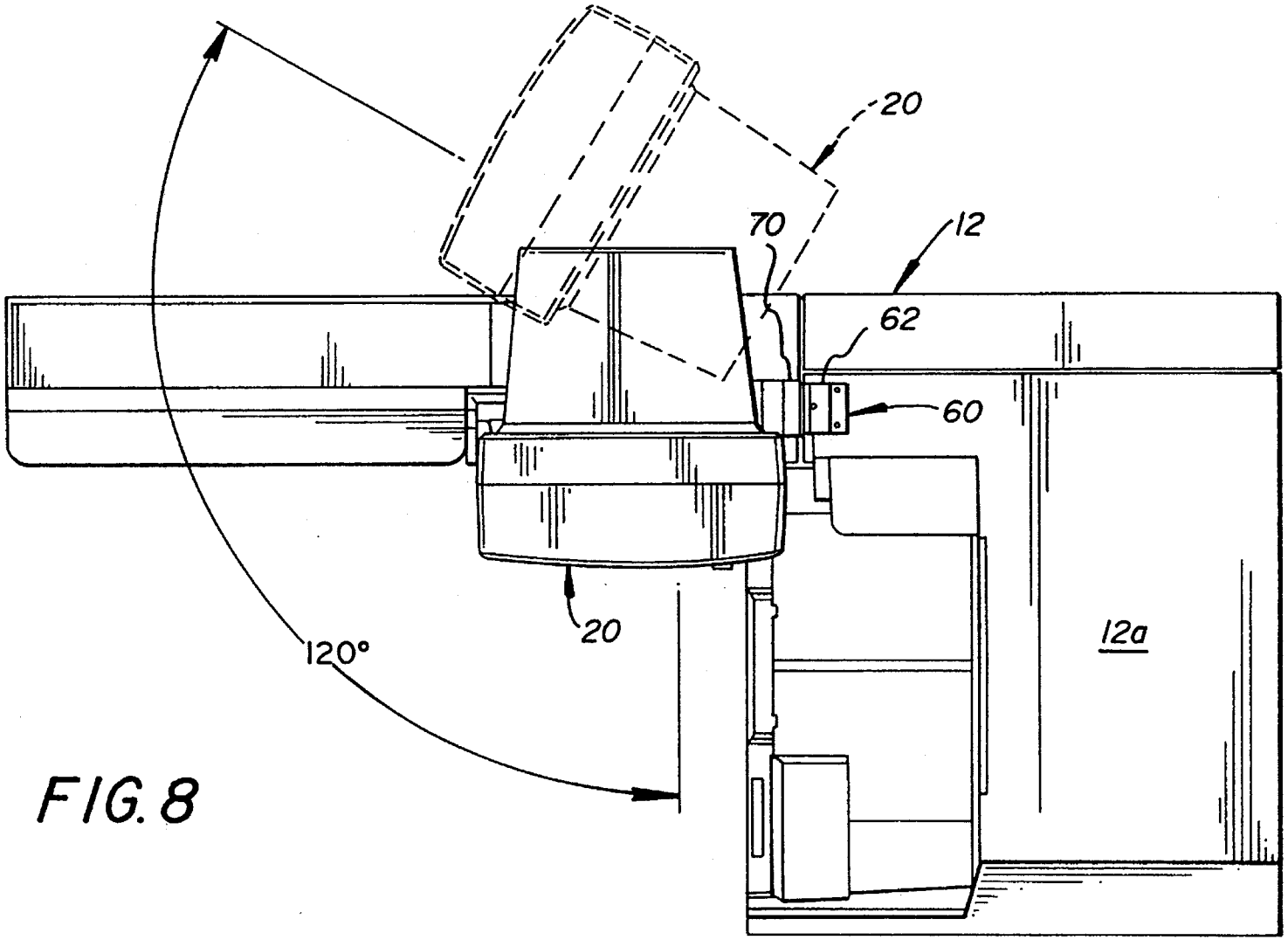
FIG. 8 is a top plan view of the structure of FIG. 7, particularly showing the extent of movement of the user control interface from the normal user position to a service position.

As shown in FIGS. 7 and 8, because pivot bar 52 is rotatable within the receptacle 54, the user interface 20 can be rotated about the longitudinal axis of the bar from a normal operational position (solid line position of FIGS. 7 and 8) where the CRT touch screen 24 is facing the user of the reproduction apparatus 10, and a position facing the rear of the reproduction apparatus (broken line position of FIGS. 7 and 8). In the rearwardly facing position, the touch screen 24 is readily accessible by service personnel working on the apparatus from the rear. This is of distinct advantage in enabling the service person to accomplish any desired repair or diagnostic task while working from the rear of the reproduction apparatus.

Figure 9:
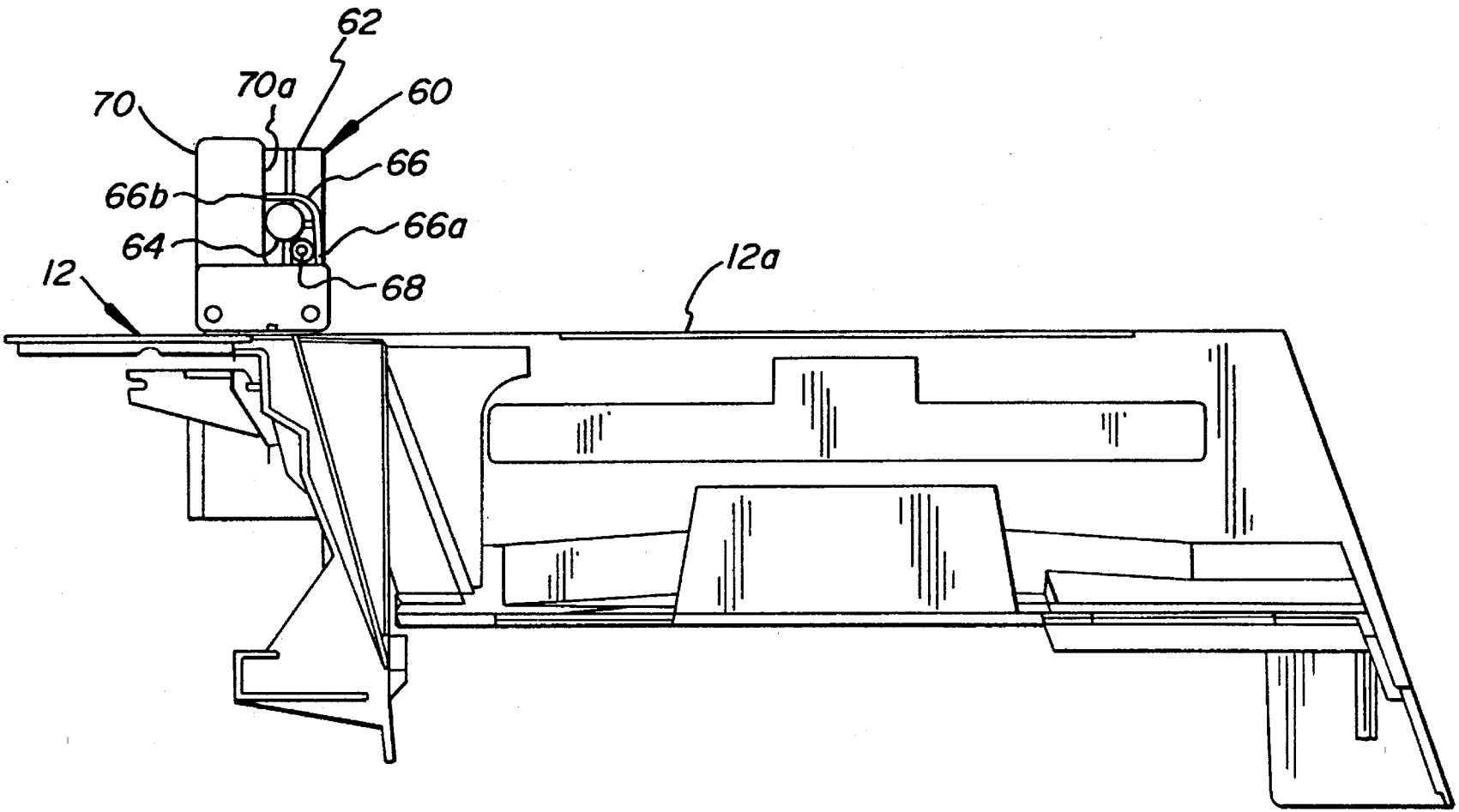
FIG. 9 is a side elevational view of the top cover, in the closed position, and the mechanism for automatically moving the user control interface support platform.
Figure 10:
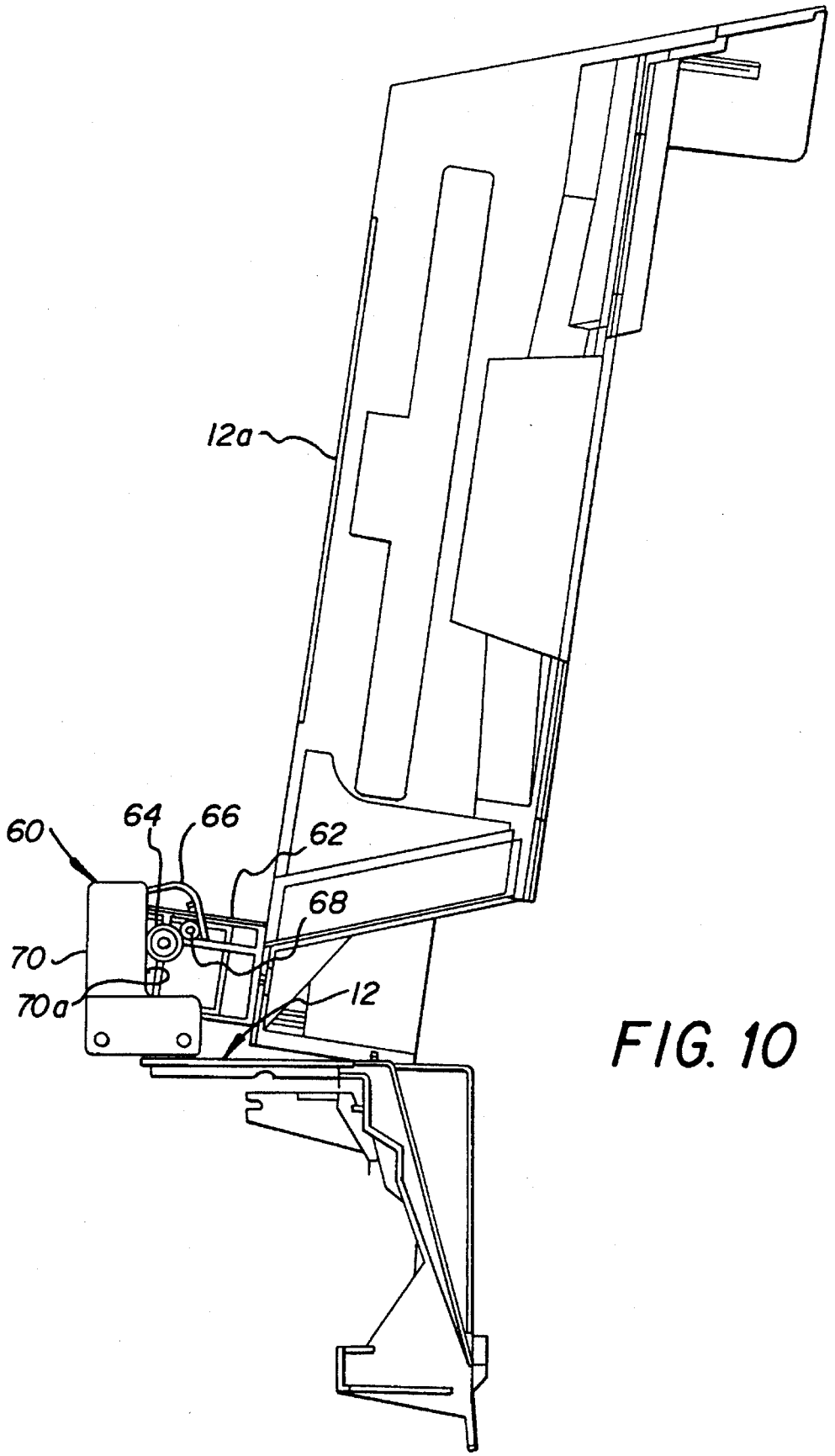
FIG. 10 is a side elevational view of the top cover, in the raised position, and the mechanism for automatically moving the user control interface support platform.

As will be readily appreciated from the above description, the user interface 20 is selectively movable in a forward direction with respect to the reproduction apparatus marking engine 12, from a home position, to facilitate use thereof. If the top cover 12*a* of the housing for the marking engine 12 of the reproduction apparatus 10 is to be raised with the user interface 20 in a position spaced forwardly from the home position, an undesirable (potentially damaging)interference will occur therebetween. According to this invention, when the top cover 12*a* is raised, the user interface 20 will be automatically returned to the home position in order to avoid such interference. The mechanism for automatically returning the user interface, designated generally by the numeral 60, is best shown in FIGS. 4, 9, and 10. The mechanism 60 includes an actuating member 62 attached to the top cover 12*a* at a predetermined location (front-to-back), and a reaction member 70 attached to the housing of the CRT 22 of the user interface 20.

The actuating member 62 of the automatic return mechanism 60 supports a camming member 64, such as a roller or the like, and a safety cover 66 for the camming member. The cover 66 is attached to the housing member 62 at one end 66*a* by a spring-loaded pivot assembly 68. The reaction member 70 has a cam surface 70*a*. The actuating member 62 and the reaction member 70 are relatively located by the respective attachment at predetermined locations to the top cover 12*a* and the housing of the CRT 22 (see FIGS. 9 and 10) so that the cam surface 70*a* is adapted to be engaged by the camming member 64 and the free end 66*b* of the safety cover 66. Accordingly, when the user interface 20 is spaced from the home position, as the top cover is raised, the camming member 64 (and the free end 66*b* of the safety cover) engage the cam surface 70*a* to urge the user interface to the home position automatically. The engagement of the safety cover 66 with the reaction member 70 protects the user from potential injury by preventing contact with the camming member 64. Of course, the safety cover may be eliminated if it is determined that it is not required.

Figure 11:
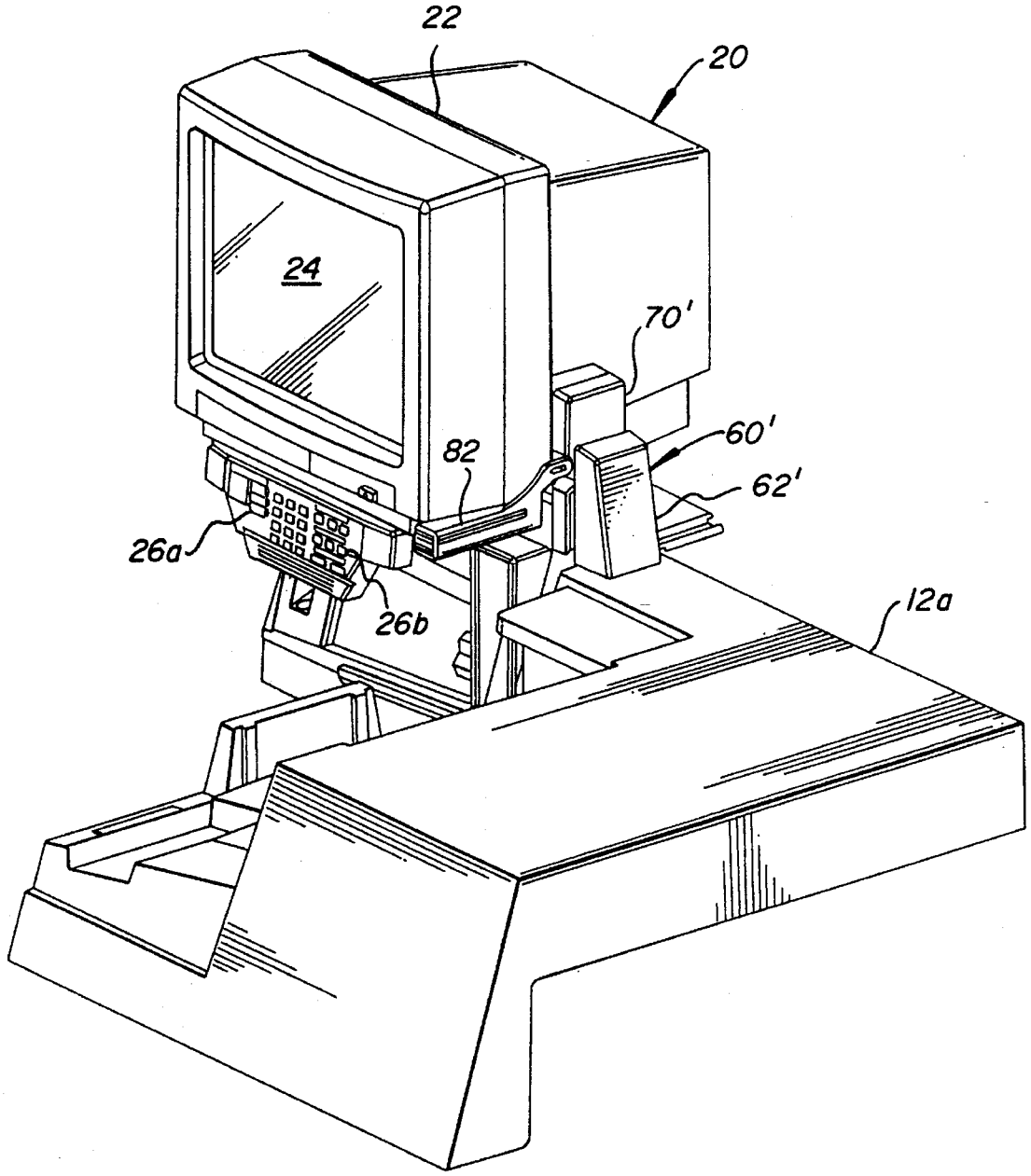
FIG. 11 is a view, in perspective and on an enlarged scale, of the user control interlace and the associated top cover of the reproduction apparatus housing, similar to FIG. 4, showing an alternate arrangement for the mechanism for automatically returning the interface to the home position when the top cover is raised.
Figure 12:
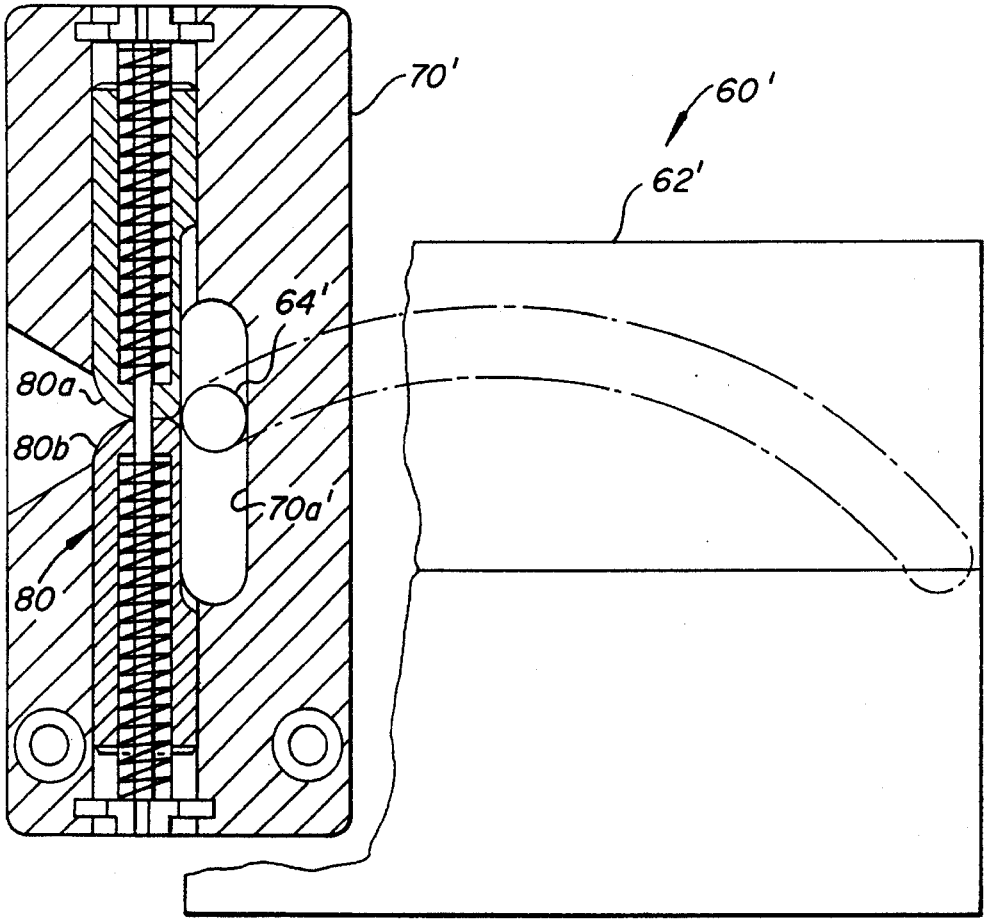
FIG. 12 is a side elevational view, on an enlarged scale, of the alternate mechanism of FIG. 11 for automatically returning the interface to the home position when the top cover is raised.

FIGS. 11 and 12 show an alternate arrangement of the mechanism 60, designated by the numeral 60', for automatically returning the user interface 20 to a home position when the top cover 12*a* of the reproduction apparatus 10 is raised. The alternate arrangement 60' includes an actuating member 62' attached to the top cover 12*a* at a predetermined location (front-to-back), and a reaction member 70' attached to the housing of the CRT 22 of the user interface 20. The actuating member 62' supports a camming member 64', such as a roller or the like. The reaction member 70' has a cam surface 70*a'* adapted to be engaged by the camming member 64'.

A releasable locking assembly 80 of the reaction member 70' includes a pair of opposed, spring urged members 80*a* and 80*b*. The lead edges of the members 80*a*, 80*b* are tapered to enable the camming member 64' to act on the members and urge the members apart so that the cam member is received therebetween. Thereafter the members 80*a*, 80*b* entrap the camming member 64' and hold such member in operative association with the cam surface 70*a'*. That is, when the top cover 12*a* is raised, the camming member 64' will enter the reaction member 70' through the tapered portions of the members 80*a* and 80*b* of the locking assembly 80 to be held by such members in engagement with the cam surface 70*a'*. The extent of the cam surface 70*a'* in the vertical direction (as shown in FIG. 12) is sufficient to enable the camming member 64', through engagement with the cam surface, to move the reaction member 70', and thus the user interface 20, to the home position as the top cover 12*a* of the reproduction apparatus is raised. The movement of the camming member 64' over the extent of its travel is shown as the broken lines of FIG. 12.

Conversely, since the rear-facing surfaces of the members 80*a*, 80*b* are not tapered, when the top cover 12*a* is lowered, the camming member 64' cannot act to urge the members apart. The camming member 64' thus acts on such rear surfaces of the locking assembly members 80*a* and 80*b* so that the reaction member 70', and thus the user interface 20, is automatically returned to the forward position with the camming member. A release mechanism 82 (see FIG. 11) is associated with the user interface 20 such that, when selectively depressed, the release mechanism 82 will urge the locking assembly members 80*a* and 80*b* apart. With the members 80*a*, 80*b* forced apart by the relase mechanism 82, the camming member 64' can be separated from the reaction member 70' when the top cover 12*a* is closed. That is, if so desired, when the top cover 12*a* is closed, carrying the camming member 64' of the actuating member 62' therewith, the camming member will exit through the forced-apart members 80*a*, 80*b* to separate the actuating member from the reaction member 70'. Accordingly, the user interface 20 can be caused to selectively remain in the home position on closure of the top cover 12*a*.

Figure 13:
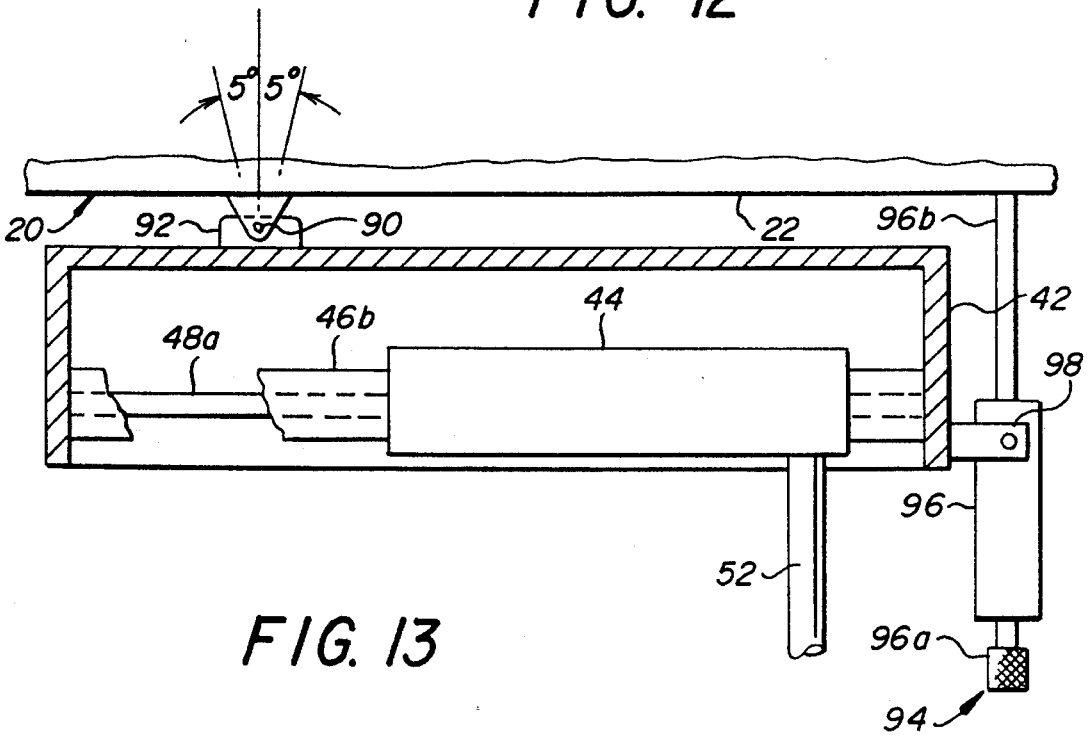
FIG. 13 is a side elevational view, on an enlarged scale and in cross-section, with portions removed to facilitate viewing, of an alternate embodiment of the user interface slide support having a mechanism to enable the user interface to be tilted.

An alternate embodiment of the user interface support platform 42 is shown in FIG. 13. It is the general purpose of the alternate embodiment to enable the user interface to be tilted about a horizontal axis, so as to prevent glare on the screen 24 or make the CRT of the user interface otherwise easier to see. In this embodiment the CRT housing 22 is mounted, near the front thereof, on a substantially horizontal pivot pin 90. The pivot pin 90 is supported by plates 92 (one shown in FIG. 13) extending from the upper surface of the platform 42. A counter-balance mechanism 94 is provided adjacent to the rear of the CRT housing 22. The counter-balance mechanism 94 includes a pneumatic cylinder 96 attached to the platform 42 for limited pivotal movement by a pivot assembly 98. The distal end of the piston rod 96*b* of the pneumatic cylinder is fixed to the CRT housing 22. The force for movement of the piston rod 96*b* is selectively adjustable by any well known mechanism controlled for example by the knob 96*a*. The particular force of the pneumatic cylinder 96 is selected to permit a user to readily manually tilt the housing 22 of the user interface 20 about the pivot pin 90 to a limited degree (e.g., ±5° from the vertical), while thereafter retaining the CRT housing in the selected tilted position.

The invention has been described in detail with particular reference to preferred embodiments thereof, but it will be understood that variations and modifications can be effected within the spirit and scope of the invention as set forth in the claims.

What is claimed is:

1. A mechanism for mounting a user control interface for inputting instruction signals to a logic and control unit controlling the operation of functional elements within the housing of a reproduction apparatus for movement relative to the reproduction apparatus housing, said mounting mechanism comprising:

a user control interface support platform;

means for slidably supporting said platform for movement, relative to said reproduction apparatus housing, to a home position and a position spaced from said home position where said user control interface is readily accessible by a user; and means for automatically moving said platform to its home position when a portion of said reproduction apparatus housing is opened to provide access to the interior of said housing.

2. The mounting mechanism of claim 1 wherein said slidable platform support means includes as least one guide member attached to said reproduction apparatus housing, and a slide member attached to said platform and cooperating with said guide member.

3. The mounting mechanism of claim 2 wherein said guide member is oriented in a substantially horizontal plane in a direction from front to back of said reproduction apparatus.

4. The mounting mechanism of claim 3 wherein said guide member is oriented such that said home position is to the rear of said reproduction apparatus, and said spaced position is to the front of said reproduction apparatus.

5. The mounting mechanism of claim 2 wherein said slidable platform support means further includes means for pivoting said platform about a substantially vertical pivot axis to position said user control interface for use in a service position.

6. The mounting mechanism of claim 5 wherein said pivoting means includes a substantially vertical shaft attached at one end to said platform and supported adjacent to the opposite end in said housing, the longitudinal axis of said shaft forming said pivot axis for said platform, whereby said platform can be turned about said pivot axis to substantially face the rear of said reproduction apparatus.

7. The mounting mechanism of claim 5 wherein said slidable platform support means further includes means for tilting said user control interface about a substantially horizontal axis oriented in a direction from side to side of said reproduction apparatus.

8. The mounting mechanism of claim 1 wherein said means for automatically moving said platform to its home position includes an actuation member connected to said cover for movement therewith in a prescribed path, and a reaction member connected to said user interface located to intercept said prescribed path of said actuation member.

9. The mounting mechanism of claim 8 wherein said actuation member includes a camming member, and said reaction member includes a cam surface adapted to be engaged by said camming member.

10. The mounting mechanism of claim 9 further including a safety cover overlying said camming member when in engagement with said cam surface.

11. The mounting mechanism of claim 8 wherein said reaction member includes a releasable locking assembly including a pair of opposed, spring urged members, the lead edges of said members being tapered to enable said camming member to act on said spring urged members and urge said members apart so that the camming member is received therebetween to entrap said camming member and hold said camming member in operative association with said cam surface whereby, when in engagement, said reaction member moves with said actuating member to said home position and away from said home position to said spaced position.

12. The mounting mechanism of claim 11 wherein said reaction member further includes a release mechanism including a selectively depressable member, associated with said user interface, such that when selectively depressed said release mechanism urges said locking assembly members apart so that said camming member can be disengaged from said cam surface.

13. A user control interface for inputting control instruction signals to said logic and control unit in a reproduction apparatus, such as a copier or printer or the like, having a housing including at least a top cover openable to provide access to the interior of said housing, and a logic and control unit for controlling the operation of the reproduction apparatus, said user control interface comprising:

a user interactive member associated with a cathode ray tube display device for displaying information relative to operation of said reproduction apparatus;

a support platform for said cathode ray tube display device;

means for slidably supporting said platform for movement, relative to said reproduction apparatus housing top cover, to a home position and a position spaced from said home position where said user control interface is readily accessible by a user; and means, associated with said top cover of said reproduction apparatus housing, for automatically moving said platform to its home position when said top cover is opened to provide access to the interior of said reproduction apparatus housing.

14. The user control interface of claim 13 wherein said slidable platform support means includes as least one guide member attached to said reproduction apparatus housing oriented in a substantially horizontal plane in a direction from front to back of said reproduction apparatus, and a slide member attached to said platform and cooperating with said guide member such that said home position is to the rear of said reproduction apparatus, and said spaced position is to the front of said reproduction apparatus.

15. The user control interface of claim 14 wherein said slidable platform support means further includes means for pivoting said platform to position said user control interface for use in a service position.

16. The user control interface of claim 14 wherein said slidable platform support means further includes means for tilting said user control interface about a substantially horizontal axis oriented in a direction from side to side of said reproduction apparatus.

17. The user control interface of claim 14 wherein said slidable platform support means further includes means for pivoting said platform to position said user control interface for use in a service position, and means for tilting said user control interface about a substantially horizontal axis oriented in a direction from side to side of said reproduction apparatus.

18. The user control interface of claim 13 wherein said means for automatically moving said platform to its home position includes an actuation member connected to said cover for movement therewith in a prescribed path, and a reaction member connected to said user interface located to intercept said prescribed path of said actuation member.

19. The user control interface of claim 18 wherein said actuation member includes a camming member, and said reaction member includes a cam surface adapted to be engaged by said camming member.

20. The user control interface of claim 19 further including a safety cover overlying said camming member when in engagement with said cam surface.

21. The user control interface of claim 18 wherein said reaction member includes a releasable locking assembly including a pair of opposed, spring urged members, the lead edges of said members being tapered to enable said camming member to act on said spring urged members and urge said members apart so that the camming member is received therebetween to entrap said camming member and hold said camming member in operative association with said cam surface whereby, when in engagement, said reaction member moves with said actuating member to said home position and away from said home position to said spaced position.

22. The user control interface of claim 21 wherein said reaction member further includes a release mechanism including a selectively depressable member, associated with said user interface, such that when selectively depressed said release mechanism urges said locking assembly members apart so that said camming member can be disengaged from said cam surface.

* * * * *